US005106295A

United States Patent [19]

Misawa

[11] Patent Number: 5,106,295

[45] Date of Patent: Apr. 21, 1992

[54] DEVICE FOR HOLDING A LONG SHAPED PRODUCT MADE OF CERAMICS DURING DRYING

[75] Inventor: Hidenobu Misawa, Toyoake, Japan

[73] Assignee: NGK Insulators, Ltd., Japan

[21] Appl. No.: 674,192

[22] Filed: Mar. 25, 1991

[30] Foreign Application Priority Data

Mar. 28, 1990 [JP] Japan ..... 2-80089

[51] Int. Cl.[5] ..... F27D 5/00

[52] U.S. Cl. ..... 432/253; 432/258

[58] Field of Search ..... 432/253, 258, 259

[56] References Cited

U.S. PATENT DOCUMENTS 2,593,015 4/1952 Dreher ..... 432/253
4,981,222 1/1991 Lee ..... 432/253
4,992,044 2/1991 Philipossian ..... 432/253
5,011,794 4/1991 Grim et al. ..... 432/253

FOREIGN PATENT DOCUMENTS 63-102911 5/1988 Japan .
63-27163 6/1988 Japan .

*Primary Examiner*—Henry C. Yuen
*Attorney, Agent, or Firm*—Parkhurst, Wendel & Rossi

[57] ABSTRACT

A device for holding at least one long shaped product made of ceramics during its drying, including an assembly having at least one straight elongated cavity in which the product to be dried can be held along its entire length. The cavity is open at both ends and surrounds the whole periphery of the product, and has a clearance between the assembly wall and the whole periphery of the product except the portion where both are contacting each other.

2 Claims, 1 Drawing Sheet

DEVICE FOR HOLDING A LONG SHAPED PRODUCT MADE OF CERAMICS DURING DRYING

BACKGROUND OF THE INVENTION

This invention related to a jig, or device for holding a long-type shaped product (or products) of ceramics when it is dried. More particularly, this invention is concerned with a device which enables the drying of any such product in such a way that it may maintain a high degree of dimensional accuracy and may not be undesirably deformed.

An extruded or otherwise shaped product of ceramics, especially a long-type one having a large length and a small wall thickness or diameter, such as a ceramic tube or rod, is liable to deformation by its own weight before it is dried, though it retains a definite shape after it has been dried. Various methods have, therefore, been proposed for restraining such deformation. According to the disclosure of Japanese Patent Publication No. 27163/1988, an elongated extruded product is received on a supporting plate and is dried by blowing, for example, hot air from a means for air supply connected to the supporting plate. According to the disclosure of the Japanese patent application laid open to the public under No. 110291/1988, an extruded tube is dried on a porous support having a recessed portion.

Although both of these methods can prevent the deformation of a long-type shaped product, such as a tube, by its own weight, they are unsatisfactory for other reasons. If the former method is employed for drying an extruded product by hot air, etc., it is likely that localized drying of the product in its surface portion will occur and may strain it and cause it to have defects such as cracks. Moreover, it is likely that, whichever method may be employed, the product may not be dried completely, but may thereafter require additionally drying. The additional drying of the product causes it to be curved along its length. Therefore, none of the known methods is suitable for making a shaped member which requires a very high level of dimensional accuracy.

SUMMARY OF THE INVENTION

Under these circumstances, it is an object of this invention to provide a device which can hold an elongated shaped product of ceramics in such a way that it may not be curved along its length, but may maintain a high level of straightness, when it is dried.

It is anothe object of this invention to provide a device which can be used effectively to hold an elongated shaped product of ceramics during its drying to provide a long product having a high level of dimensional accuracy, thereby giving an assembly of members requiring high accuracy a high working efficiency.

According to the present invention, there is provided a device for holding at least one long shaped product of ceramics during its drying comprising an assembly having at least one straight elongated cavity open at both ends. The cavity is adapted to support the shaped product on at least one portion of the assembly wall and cover the entire length and whole periphery of the shaped product with a prescribed clearance between the assembly wall and the surface of the shaped product except the aforementioned portion of the assembly wall.

As mentioned above, the device of this invention is designed for holding the product to be dried in such a way that the entire length and the whole periphery of the product can be enclosed in the wall defining the elongated cavity with a small clearance, the product being only partly held in contact with the wall of the cavity.

Therefore, when the drying device of this invention is used, almost even long-shaped products made of ceramics with very few defects can be obtained by closing in the whole area along the length axis of the cavity and holding the long-shaped product during drying, and also by providing a specified clearance between the outer surface of the shaped product and the wall of the cavity except the portion where both are contacting because the difference between the upper and lower part drying rates can be decreased to prevent deformation through drying.

On the other hand, in the conventional drying of the long extruded product on an open head type support device, because the opened upperpart has a faster drying rate than the closed lowerpart, both ends of the long shaped product of ceramics tend to warp to cause deformation through drying.

BRIEF DESCRIPTION OF THE DRAWINGS

FIG. 3(*b*) is a plane view of the device shown in FIG. 3(*a*);

DETAILED DESCRIPTION OF THE INVENTION

Figure 1:
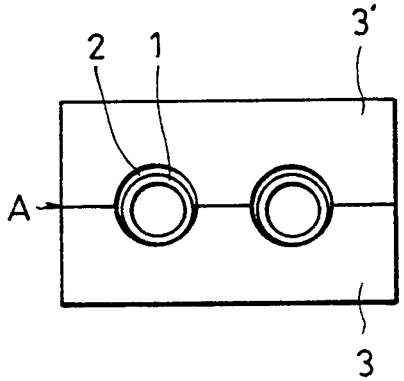
FIG. 1 is a cross-sectional view of an embodiment of the device of this invention.

The device of this invention comprises a supporting structure or assembly having at least one straight elongated cavity in which a long shaped product made of ceramics can be held along its entire length when it is dried. A cross-sectional shape of the cavity is not restricted to particular shapes and may or may not be similar to that of the shaped product to be dried. In either event, however, it is necessary that the cavity is so sized in cross section as to have a small clearance between its wall and the outer surface of the shaped product and so extended along the entire length of the shaped product as to surround substantially the whole periphery thereof.

It is desirable to have the clearance as small as possible in order to ensure that only the minimum possible amount of deformation occurs in the product when it is dried. It is, however, necessary to allow some deformation of the shaped product through drying depending on its material and drying conditions such as the temperature and manner, and to prevent it from having defects such as cracks. It is, therefore, preferable that the size of the clearance be appropriately decided according to the conditions of producing and drying of the shaped product.

In this invention, since the clearance of the device is determined according to the shaped product to be dried and the drying conditions employed, it is possible to achieve the dimensional accuracy which may be required of the shaped product when it has been fired, and which may depend on the purpose for which the shaped product will eventually be used. It is generally preferable that, since it is likely that the shaped product dried may also become curved during binder removal step and firing step following the drying step, the possibility of such later curvature, as well as the dimensional accuracy which will finally be required, be taken into consideration when the cross-sectional shape of the cavity and the clearance are determined for a device of this invention. The following are two exemplary methods for placing the shaped product in the cavity of the device for drying of this invention. One method is to insert the shaped product to be dried into the cavity through either open end thereof. The other method is to place the shaped product into the opened cavity which has been divided, as described below. The device preferably comprises an assembly formed of at least two portions which are separable from each other to open the cavity in a plane which is, for example, parallel or perpendicular to the axis along the length of the cavity, as will hereinafter be described in detail. The divided structure of the device of this invention facilitates placing and removing the shaped product into and from the cavity.

In this invention, the long shaped product to be dried can be extruded directly into the cavity through an extruder die connected to the device of this invention. The product can be also placed into the cavity after shaped. The device of this invention is preferably used when drying a long tubular shaped product having any sectional view, e.g., circular, oval, triangular, square, rectangular, hexagonal, or honeycomb-shaped cross section.

The device of this invention can also be used for drying an elongated solid product in the form of a rod.

Various kinds of materials can satisfactorily be used to form those parts which compose the device of this invention, as will hereinafter be described in detail. Some examples of the materials are metal such as aluminum, the tradename "Ceraplast" (a ceramic product by Nippon Koshitsu Toki K.K.), a sintered product of alumina, and a shaped product of an alloy of nickel and aluminum, or a shaped product of metallic powder such as stainless steel powder.

The device of this invention may have two or more cavities to enable the simultaneous drying of two or more elongated shaped products of ceramics.

The invention will now be described with reference to the drawings showing examples of device embodying this invention. The device shown in FIG. 1 comprises an assembly consisting of an upper portion 3' and a lower portion 3 which are equally shaped and sized, and define two straight elongated cavities 2 extending in parallel to each other along the length of the device. Each cavity 2 is open at both ends, though only one end thereof is shown in FIG. 1. The upper and lower portions 3' and 3 are separable from each other in a parting plane A in which the horizontal axis of each cavity 2 is located. Each cavity 2 is shown as holding a long shaped tubular product 1 of ceramics. Each cavity 2 is circular in cross section and has a diameter which is somewhat larger than the outside diameter of the tubular product 1, so that a clearance surrounds substantially the whole periphery of the tubular product 1.

Figure 2:
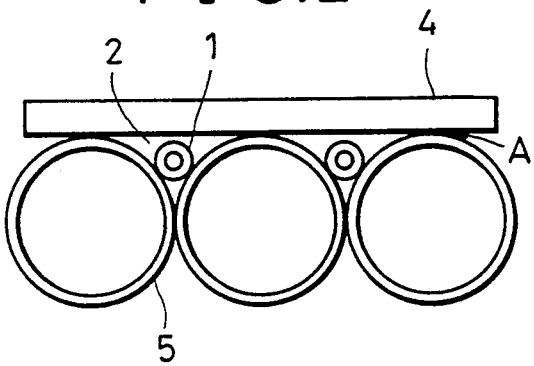
FIG. 2 is a cross-sectional view of another embodiment of the device of this invention.

The device in FIG. 2 shows an assembly consisting of a flat weight plate 4 as an upper portion and three pipes 5 disposed horizontally and put together in contact with one another in a horizontal plane to form a lower portion. The plate 4 is set on the pipes 5 and two straight elongated cavities 2 are formed as spaces between the plate 4 and the pipes 5. The upper portion of the assembly can be separated from its lower portion in a parting plane A which is a surface in contact with the plate 4 and the pipes 5. Each cavity 2 has a substantially triangular cross section and is shown as holding a long ceramic tube 1 which is only partly in contact with the two contacting pipes 5, so that a clearance surrounds substantially the whole periphery of the tube 1.

Figure 3:
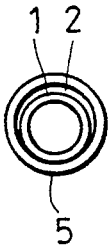
FIG. 3(*a*) is a cross-sectional view of another embodiment of the device of this invention.
Figure 3:
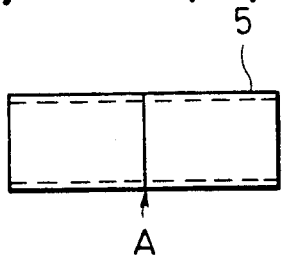

The device in FIGS. 3(*a*) and 3(*b*) shows an assembly of the simple tubular structure. More specifically, the assembly consists of a pipe 5 having a bore as a straight elongated cavity 2. The pipe 5 consists of two portions which are separable from each other in a parting plane A lying perpendicularly to the long axis of the bore. The cavity 2 is shown as holding a ceramic tube 1 and has a diameter which is somewhat larger than the outside diameter of the tube 1, so that a clearance surrounds substantially the whole periphery of the tube 1.

Referring particularly to the device of the type in which the upper portion of the assembly is separable from its lower portion as shown in FIGS. 1 or 2, it is advisable to hold the upper portion against the lower portion by, for example, applying an appropriate load to the upper portion or fastening it to the lower portion, so that the product to be dried may not undergo any undesirable upward deformation by raising the upper portion, though the necessity for doing so may depend on the material and shape of the shaped product.

The device of this invention enables an elongated shaped product of ceramics to dry without being substantially deformed and presenting any substantial defects. The shaped product which has been dried is ready for transfer to any later step of the relevant manufacturing process, such as calcining or firing, and enables the process to give an improved overall yield. The device can maintain the long shaped product within the desired range of dimensional accuracy throughout its drying, and can improve the shape accuracy thereof.

The device of this invention thereby enables the preparation of a structural member having a high level of straightness along its entire length and enables high working efficiency to be achieved in later assembly of the structural members. The device of this invention, thus, has a high degree of industrial utility.

EXAMPLE

The invention will now be described more specifically with reference to a few examples thereof. It is, however to be understood that the following description is not intended for limiting the scope of this invention.

EXAMPLE 1

A device shown in FIG. 1 was made by employing two equally shaped aluminum plates forming upper and lower portions 3' and 3, respectively. Each aluminum plate having a width of 50 mm, a length of 1000 mm and a thickness of 40 mm and was given two parallel recesses extending along its entire length and each having a semicircular cross section, so that when the two plates were put together, the recesses thereof might form two elongated cavities 2 each having a diameter of 10.1 mm.

Fine powder of silicon nitride containing a sintering agent was used for extruding two tubes 1 each having a length of 1000 mm, an outside diameter of 10 mm and an inside diameter of 8 mm. Each tube 1 was horizontally placed in one of the recesses in the lower portion 3 so as to contact with the bottom of the reccess, and the upper portion 3' was placed on the lower portion 3, so that the tubes 1 might be enclosed in the cavities 2, respectively, except at both ends thereof.

Figure 4:
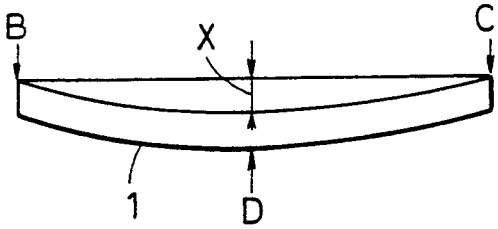
FIG. 4 is a diagram illustrating a method of measuring the curvature of an elongated shaped product of ceramics after dried or fired.

A dryer in which a constant temperature of 80° C. and a constant humidity of 90% were maintained was used to dry the tubes 1 for 16 hours. The amount of deformation which might have occurred to each tube 1 during its drying was measured by the method illustrated in FIG. 4. The distance X between a straight line connecting the upper points B and C of both ends of each tube 1 and the middle point D of the tube 1 was measured on a line normal to the line B-C to get the amount of its curvature. Both of the tubes 1 showed an X value of only 0.1 mm.

Then, both of the dried tubes 1 were calcined at 500° C. for an hour, and fired at 1700° C. for an hour to yield two sintered tubes. The sintered tubes were both free of any defects. The method shown in FIG. 4 was employed again for measuring the amount of curvature of each sintered tube. The tubes showed X values of only 0.07 and 0.09 mm, respectively.

EXAMPLE 2

Example 1 was repeated for preparing a device, and molding, drying, and firing two tubes, except that the diameter of each cavity 2 was increased to 11 mm. The tubes after dried showed each an X value, or the amount of the curvature of only 1 mm. The sintered tubes showed X values of only 0.6 and 0.9 mm, respectively, and were both free of any defects.

COMPARATIVE EXAMPLE 1

Figure 5:
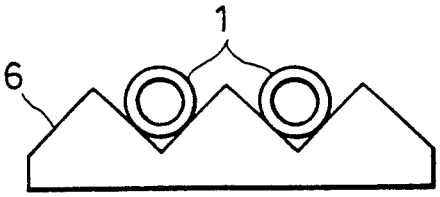
FIG. 5 is a cross-sectional view of a conventional device for drying an elongated shaped product of ceramics.

Example 1 was followed for extruding two tubes. They were dried on a support known in the art as shown in FIG. 5. The support 6 had two recesses in which the two tubes 1 were respectively placed. Each recess was open at its top. Example 1 was also followed for firing the tubes and measuring the amount of the curvature of each tube after dried and after fired. The tubes after dried showed X values of 5 and 7 mm, respectively, and the sintered tubes showed X values of 2.5 and 6.0 mm, respectively.

As is obvious from the results of Examples 1 and 2 and Comparative Example 1, all of the elongated shaped products of ceramics which had been dried in the device embodying this invention showed only a very small amount of curvature and a high level of dimensional accuracy.

What is claimed is:

1. A device for holding at least one elongate ceramic product while drying, comprising upper and lower elongate plates, each plate having at least one longitudinally extending groove formed in a planar surface thereof, wherein the planar surfaces of said elongate plates are abutted together such that the grooves in each plate cooperate to define at least one longitudinally extending cavity open at both ends thereof and having a cross-sectional shape substantially corresponding to that of the ceramic product, said cavity supporting the entire ceramic product therein on at least a portion of an inner surface defining said cavity while maintaining a predetermined clearance between the ceramic product and a remaining portion of said inner surface.

2. A device for holding at least one elongate ceramic product while drying, comprising:

at least two elongate pipes disposed such that at least a portion of outer surfaces thereof contact each other; and an elongate plate disposed on said outer surfaces of said at least two elongate pipes so as to form at least one longitudinally extending cavity between a surface of said plate and portions of said outer surfaces of said at least two elongate pipes;

wherein said cavity is open at both ends thereof and said cavity supports the entire ceramic product therein on at least a portion of said portions of said outer surface of said at least two elongate pipes while maintaining a predetermined clearance between the ceramic product and a remaining portion of said portions.

* * * * *